United States Patent [19]

Joscelyn

[11] 4,072,831

[45] Feb. 7, 1978

[54] VOICE TRANSMITTING APPARATUS FOR A BREATHING MASK

[75] Inventor: Edwin Joscelyn, Commack, N.Y.

[73] Assignee: Instrument Systems Corporation, Huntington, N.Y.

[21] Appl. No.: 722,251

[22] Filed: Sept. 10, 1976

[51] Int. Cl.[2] ..... H04R 1/08

[52] U.S. Cl. ..... 179/188

[58] Field of Search ..... 179/187, 188, 179, 184, 179/139

[56] References Cited

U.S. PATENT DOCUMENTS

| | | | |
|---|---|---|---|
| 2,937,244 | 5/1960 | Weinger | 179/188 |
| 3,064,089 | 11/1962 | Ward | 179/122 |
| 3,540,442 | 11/1970 | Holloway | 128/141 |

FOREIGN PATENT DOCUMENTS

| | | | |
|---|---|---|---|
| 1,325,254 | 3/1963 | France | 179/188 |

*Primary Examiner*—William C. Cooper

*Attorney, Agent, or Firm*—Blum, Moscovitz, Friedman & Kaplan

[57] ABSTRACT

An apparatus for transmitting the wearer's voice is mounted inside a breathing mask and includes a microphone and a protective sheath substantially encasing the microphone. The protective sheath includes a thin, pliable wall which is kept in contact with the sensing diaphragm of the microphone so that, when the wearer speaks and sets the sheath wall into vibration, the vibration is directly communicated to the microphone diaphragm. In one illustrative embodiment, the sheath is formed as an integral, continuous pocket in the mask body which extends inside the mask and has an opening out of the mask.

11 Claims, 7 Drawing Figures

VOICE TRANSMITTING APPARATUS FOR A BREATHING MASK

BACKGROUND OF THE INVENTION

The invention relates generally to breathing masks adapted to be worn on the face of a human being, and in particular to an apparatus for use with a breathing mask to transmit the wearer's voice outside the mask.

Breathing masks are well known in the prior art. Such masks are used, for example, by military jet pilots to aid them in breathing at high altitudes. A typical mask includes a generally cup-shaped main body which is made of a pliable, air impermeable material, such as rubber; and the main body is coupled to a source of an oxygen-rich breathing mixture by means of a hose, or the like. In use, the mask is worn over the nose and mouth and forms an air-tight seal with the wearer's face. In most cases, the mask is also provided with a strap which passes around the wearer's head and holds the mask in place so that the wearer can have his hands free while breathing through the mask.

In order to permit the wearer to transmit his voice outside the mask, prior art masks have included built-in microphones. Unfortunately, the introduction of a microphone into the interior environment of the mask introduces a number of problems which, until the present invention, have not been adequately solved. First of all, it is very dangerous to include an electrical device such as a microphone in an oxygen-rich environment because of the ever present danger that an electrical spark may ignite the oxygen within the mask. In addition, the oxygen-rich environment and moisture introduced from the wearer's breath may very rapidly corrode the metal parts of the microphone. Furthermore, the microphone, which senses sounds inside the mask and communicates with a point outside the mask, has always either been mounted so that it penetrates the body of the mask or has been mounted inside the mask and has included an electrical connector that penetrated the body of the mask. In either case, openings must be provided in the body of the mask, and, even if these openings can be sealed adequately when the mask is new, they often leak as the mask ages or wears with use.

SUMMARY OF THE INVENTION

Broadly, it is an object of this invention to provide a breathing mask which eliminates one or more of the aforementioned problems in existing breathing masks. Specifically, it is within the contemplation of the present invention to provide a breathing mask including a built-in microphone in which the microphone is isolated from the dangerous and corrosive atmosphere within the mask.

It is another object of this invention to provide a breathing mask with a built-in microphone which is isolated from the dangerous and corrosive atmosphere within the mask in such a manner that the effectiveness of the microphone is not impaired.

It is yet another object of this invention to provide a voice sensing apparatus in a breathing mask, which apparatus is coupled to a point outside the mask without penetrating the body of the mask.

It is also an object of this invention to provide a voice sensing apparatus in a breathing mask, which apparatus is reliable and convenient in use, yet simple and inexpensive in construction.

Still other objects and advantages of the invention will in part be obvious and will in part be apparent from the specification.

In accordance with one aspect of the invention, a microphone inside a breathing mask is encased in a protective sheath. The sheath includes a thin pliable wall which is maintained in contact with the voice sensing diaphragm of the microphone. When the wearer speaks the sheath wall is set into vibration, the microphone diaphragm likewise vibrates because it is in contact with the sheath wall, and the wearer's voice is transmitted (in the form of an electrical signal) without material impairment in microphone effectiveness.

In one illustrative embodiment of the invention, a protective sheath, constructed as described, is integrally formed as a continuous pocket in the body of the mask such that the pocket extends into the interior of the mask and has an opening extending out of the mask body. The microphone is mounted inside the pocket with its diaphragm-bearing front portion directed toward the interior of the mask body and contacting the thin, pliable wall which is in the pocket. The microphone's rear portion, to which there are connected electric wires, extends outside the mask through the pocket opening. As a result of this construction and arrangement, the microphone can communicate with the interior of the mask through the thin, pliable wall and can be coupled to a point outside the mask without requiring holes in the mask body.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
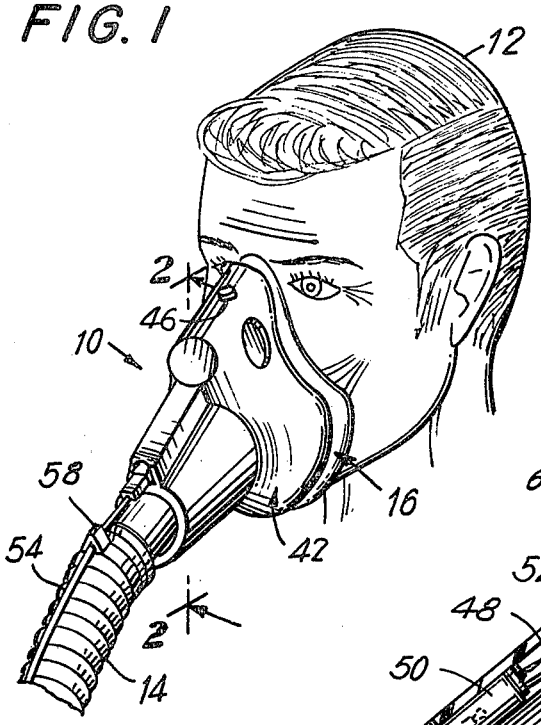
FIG. 1 is a perspective view showing a first breathing mask, embodying the invention, applied to the face of the wearer.
Figure 2:
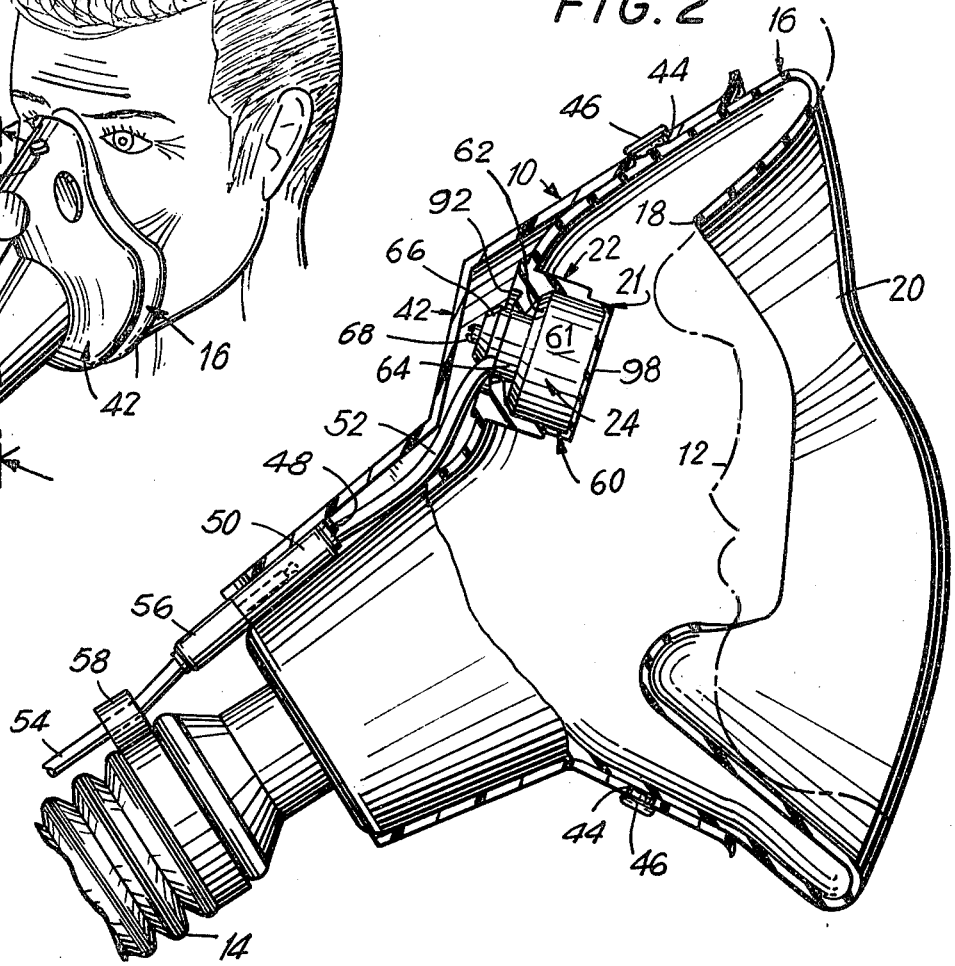
FIG. 2 is a partial sectional view, on an enlarged scale, taken substantially along line 2—2 in FIG. 1 and looking in the direction of the arrows.

Referring now to the details of the drawing and, in particular, to FIGS. 1 and 2, there is shown a first breathing mask, indicated generally by the numeral 10, which incorporates objects and features of the present invention. Mask 10 is applied to the face of the user 12 to form an air-tight seal therewith, and is held in position by means of a strap (not shown) which passes around the head of the user. The mask 10 is coupled to a source of a breathing mixture (not shown) by means of a conventional hose 14, which is secured to the mask by conventional means (not shown).

As best shown in FIG. 2, the mask 10 includes a main body 16 which is preferably made of rubber. In order to form an air-tight seal with the wearer's face regardless of the size and shape of his features, the face-receiving opening 18 of the mask is formed by looping the mask inwardly on itself to form a broad surface 20 for contacting the wearer's face. The mask body 16 includes an apparatus 21 for transmitting the wearer's voice, outside the mask. Apparatus 21 broadly comprises a sheath 22, discussed more fully hereinafter, which is integrally formed in the mask body 16 and a microphone 24 encased in sheath 22.

A relatively rigid mask shield 42, preferably made of plastic, is mounted over mask body 16 to lend support thereto. The shield 42 has a pair of apertures 44, 44 therein, and generally mushroom shaped buttons 46, 46 extends outwardly from mask body 16, and are pressed through apertures 44, 44 to secure shield 42 to mask body 16. At its lower end, shield 42 includes an integrally formed clip 48 which retains a conventional jack 50, and a short length of cable 52 is connected between microphone 24 and jack 50 to provide means for making a breakable electrical connection from a remote point to microphone 24. This connection to microphone 24 is made by means of a cable 54 having a conventional plug 56 at its end. A conventional cable clamp 58 is mounted on hose 14 to support cable 54.

Figure 4:
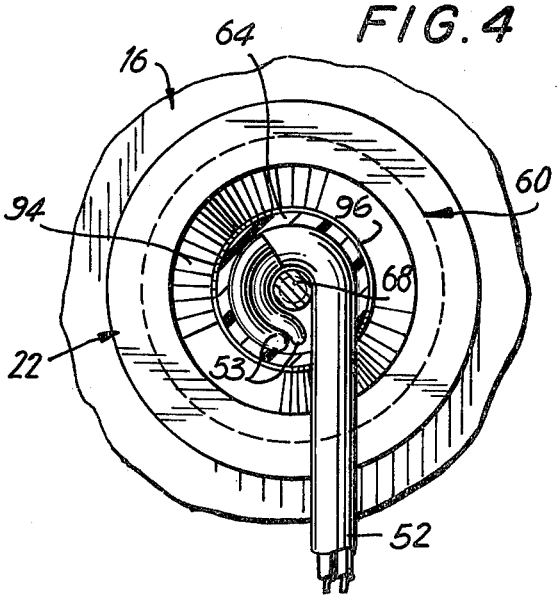
FIG. 4 is a sectional view taken substantially along contour 4–4 in FIG. 3 and looking in the direction of the arrows.

Microphone 24 has a housing 60, preferably made of plastic, which has a generally cylindrical side wall 61 and a top wall 62. Cylindrical flange 64, which is concentric with side wall 61, extends above top wall 62 and receives a cap 66 which has a central aperture for receiving a bolt 68. As will be more fully explained below, flange 64, cap 66 and top wall 62 cooperate to form a chamber 67 for receiving cable 52. The bolt 68 also extends through a central aperture in top wall 62, and a nut 70 which is received in a concentric recess 72 in the undersurface of top wall 62, is secured at the lower end of bolt 68. In this manner, cap 66 is securely fastened to housing 60. Cable 52, which has a pair of wires 53, 53 that provide an electrical connection to microphone 24, enters the microphone via cut outs in flange 64 and cap 66, passes between cap 66 and the top wall 62, is wrapped around a post defined by bolt 68, and passes through a hole in top wall 62 (see FIG. 4) into the interior of microphone 24. When nut 70 is tightened on bolt 68, cable 52 is clamped between cap 68 and top wall 62, so that strain relief is provided against cable 52 being pulled out of its connection with the interior of microphone 24.

A toroidal permanent magnet 74 is mounted inside housing 60 concentrically with side wall 61. A metallic disc 76 which is secured in a recessed seat 78 in the lower edge of side wall 61, a metallic sleeve 80 which is received in a recessed seat 82 formed on top of disc 78, and a metallic disc 84 which is mounted in a flanged seat 85 on the undersurface of top wall 62 cooperate to retain magnet 74 in housing 60. Disc 76 and cylinder 80 are constructed to form a toroidal air gap 86 about the lower portion of the periphery of magnet 74. In the illustrative embodiment discs 76 and 84 and cylinder 80 are made of a magnetic material, so that the flux from magnet 74 is concentrated in the gap 86. A diaphragm 88 is mounted across the open bottom of housing 60 and has secured thereto a toroidal winding 90 which is connected to wires 53, 53 and which extends upward into gap 86.

In operation, diaphragm 88 is subjected to vibration, for example, by a noise such as the wearer's voice, whereby the winding 90 secured thereto is caused to fluctuate within the concentrated magnetic filed in gap 86. As a result, an electric current representing the noise sound which actuated the diaphragm is induced in winding 90 and is transmitted over cable 52.

Figure 3:
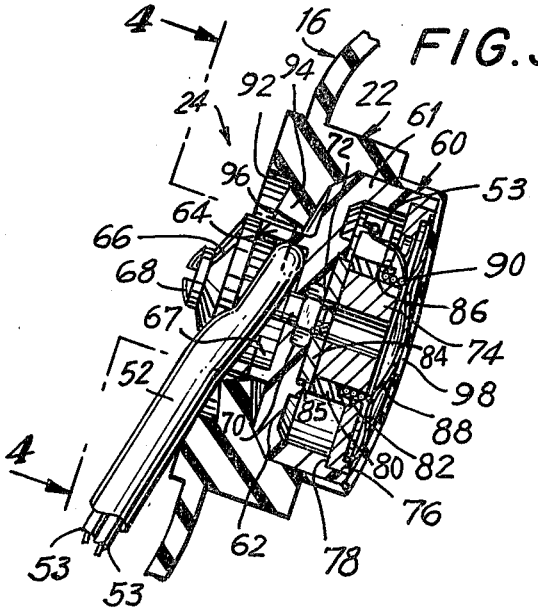
FIG. 3 is a fragmentary view, on an enlarge scale, of the microphone-bearing portion of the mask of FIG. 2, and shows the microphone in section.

As best seen in FIGS. 2 and 3, sheath 22 is integrally formed as a pocket in mask body 16 and extends into the interior thereof. Sheath 22 froms a continuous pocket in body 16 in the sense that it has no openings into the interior thereof which extend into the outside environment. Sheath 22 does have an opening 92 which extends out of mask body 16 but this opening does not extend to the interior of the mask. In the opening 92 there is formed a thick flange 94 defining an aperture 96 of smaller diameter than the outside diameter of flange 64. The lower portion of sheath 22 includes a thin, pliable wall 98 which contacts diaphragm 88 when microphone 24 is inserted inside sheath 22. To achieve this insertion, the aperture 96 is forced open by spreading the flange 94, and microphone 24 is inserted. When flange 94 is released it bears against flange 64 as shown in FIG. 3, because the outside diameter of flange 64 is larger than the diameter of aperture 96. As a result, of its resilience, flange 94 firmly presses against flange 64 and forms an effective seal therebetween, and, in addition, applies a forch which presses microphone 24 downwards, so that diaphragm 88 is firmly held against wall 98. In operation, the wearer's voice excites wall 98 and causes it to vibrate. As a result of the contact between wall 98 and diaphragm 88, the latter is forced to vibrate with the former and a signal is transmitted via cables 52 and 54 to a remote point, as previously explained.

Figure 5:
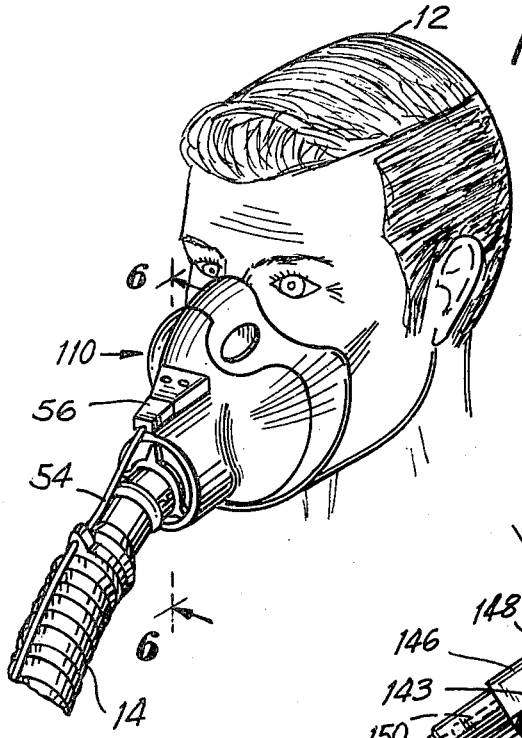
FIG. 5 is a perspective view showing a second breathing mask, embodying the invention, applied to the face of the wearer.

Referring now to FIG. 5, there is illustrated in an alternate embodiment of a breathing mask 110 incorporating objects and features of the present invention, which mask is shown in its normal operating position on the face of the user. For consistency, components of the mask 110 which are identical to those in mask 10 will be represented by the same reference numeral. Like mask 10, mask 110 is connected to a source of a breathing mixture (not shown) through a conventional hose 14, which hose is secured to the mask by means of a conventional hose-receiving fitting 26 and a hose clamp 40.

Figure 6:
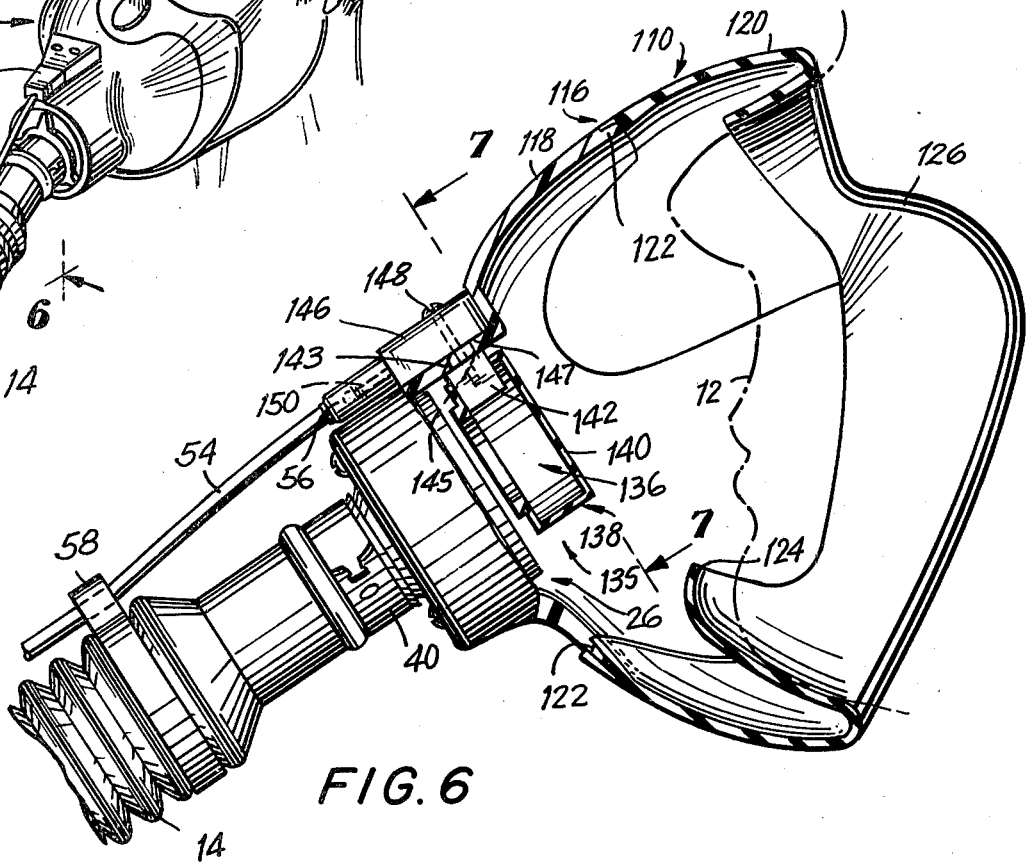
FIG. 6 is a partial sectional view, on an enlarged scale, taken substantially along line 6—6 in FIG. 5 and looking in the direction of the arrows.

Referring now to FIG. 6, it will be observed that the mask includes a main body 116 which includes a relatively rigid front portion 118, preferably made of plastic, and a pliable rear portion 120, preferably made of rubber. Portions 118 and 120 of mask 116 are securely bonded at 122 to form a seam that will not leak or open under normal use. Rear portion 120 has an opening 124 for receiving the wearer's nose and mouth, and like body 16 of mask 10 is looped inwardly on itself to form a broad surface 126 to seal the mask against the face of the wearer despite the actual size and shape of his features.

Within the mask 110 there is included an apparatus 135 for transmitting the voice of the wearer which broadly comprises a microphone 136 of conventional design and a sheath 138, preferably made of rubber, which substantially encases the microphone 136. Like microphone 24 of the first embodiment, microphone 136 includes a voice sensing diaphragm (not shown), and sheath 138 has a thin, pliable wall 140 which contacts the microphone diaphragm. As a result of providing this contact between wall 140 and microphone diaphragm, there is no noticable reduction in the performance and effectiveness of microphone 136 when the protective sheath 138 is placed thereover.

Figure 7:
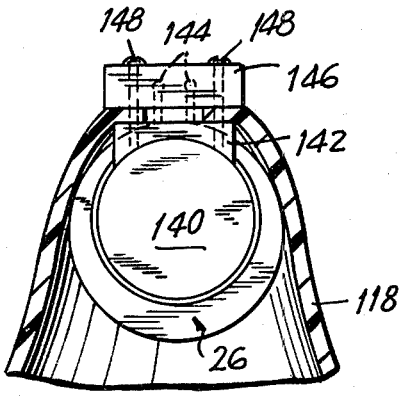
FIG. 7 is a sectional view taken along lines 7—7 in FIG. 6 and looking in the direction of the arrows.

Microphone 136 includes a connector member 142 which has a face or wall 143 adapted to be mounted to the inside of wall portion 118. A pair of electrical plugs 144, 144 (see FIG. 7) are connected to the interior of microphone 136 and protrude from mounting wall 143. The connector 142 is positioned inside the mask 116 immediately above hose connector 26 and in registration with aperture 145 in wall portion 118. Mounting wall 143 engages the interior of mask portion 118 at the periphery of aperture 145 and is secured in this position in a manner to be described more fully hereinafter. With connector 142 in its secured position, the plugs 144 extend through aperture 145 in mask portion 118. An electrical connector 146, which has a mounting face or wall 147 for engaging the exterior of mask portion 118 about the periphery of aperture 145 and includes receptacles for the plugs 144, is secured by means of bolts 148, 148 to connector 142. For this purpose, bolts 148, 148 pass through connector 146 and are anchored in connector 142. When the bolts 148 are tightened, the part of mask portion 118 defining the periphery of aperture 145 is sandwiched between walls 143 and 147 of the connectors 142 and 146, respectively; so that both connectors seal against mask portion 118 and are securely held in place. Coupled to the receptacles for plugs 144, 144, the connector 146 includes a conventional plug 150 which protrudes therefrom and provides electrical access to microphone 136. Microphone 136 is electrically coupled to a remote point by means of a cable 54 which terminates in a conventional jack 56. To establish the connection the jack 56 is mated with the plug 150 on connector 146.

Although specific embodiments of the invention have been described for illustrative purposes, it will be appreciated by one skilled in the art that many additions, substitutions and modifications are possible without departing from the scope and spirit of the invention as disclosed in the accompanying claims. In particular, it will be understood that the invention is not limited to use in breathing masks for pilots, but could equally well be employed in other types of masks such as drivers' masks or gas masks.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus, constructed to be mounted in a breathing mask adapted to be worn on the face of a human being for transmitting the wearer's voice outside said mask, said breathing mask having a hollow generally cup-shaped mask body adapted to cover at least the mouth and nose region of the wearer's face, comprising:

a microphone adapted to be connected in communication with a point outside said mask, said microphone having a diaphragm constructed and arranged to be set into vibration to generate an electrical signal; and a protective sheath substantially encasing said microphone and including a thin, pliable wall in contact with said diaphragm, the wearer's voice being effective to set said wall into vibration so that said diaphragm is made to vibrate therewith, whereby an electrical signal representing the wearer's voice is generated by said microphone, said protective sheath being an integral pocket formed in said main body and extending into the interior of said mask, said pocket having an opening extending outside said main body.

2. An apparatus according to claim 1 wherein said opening includes a resilient flange portion partially closing off said opening, said flange portion being stretched to open said sheath for inserting said microphone therein and being released after insertion of said microphone to close around said microphone and to apply a resilient force thereto for retaining said microphone in said sheath and said diaphragm in contact with said thin, pliable wall thereof.

3. In a breathing mask adapted to be worn on the face of a human being, said mask including a pliable, air impermeable, generally cup-shaped mask body coupled to a source of a breathing mixture and adapted to be placed on the face of the wearer to form an air seal therewith, an apparatus mounted inside said mask for transmitting the wearer's voice outside said mask, comprising:

a microphone adapted to be connected in communication with a point outside said mask, said microphone having a sound sensing diaphragm and being constructed and arranged to generate an electrical signal representing sounds sensed by said diaphragm, and a microphone protecting sheath substantially encasing said microphone and including a thin, pliable wall in contact with said sensing diaphragm, said sheath wall being set into vibration when the mask wearer sounds his voice, said vibration being communicated to said sensing diaphragm so that an electrical signal representing the wearer's voice is produced by said microphone, said protective sheath being formed as an integral pocket in said mask body, said pocket extending into the interior of said mask and having an opening extending out of said mask body, said sheath being constructed to receive said microphone with a snug fit.

4. The breathing mask of claim 3 wherein said sheath opening includes a resilient flange at least partially closing off said opening, said flange portion being stretched to open said sheath for inserting said microphone therein and being released after insertion of said microphone to close around said microphone and to apply a resilient force thereto for retaining said microphone in said sheath and said diaphragm in contact with said thin, pliable wall thereof.

5. The breathing mask of claim 3 further comprising means, coupled to said microphone through said sheath opening, for providing a removable electrical connection thereto.

6. The breathing mask of claim 5 further comprising a relatively rigid, generally cup-shaped protective shield mounted over said mask, said shield including means for holding said means for providing an electrical connection to said microphone.

7. The breathing mask of claim 5 wherein said means for providing an electrical connection to said microphone is coupled to said microphone through a cable, said microphone including a housing having a chamber for receiving a length of said cable, a wall closing the bottom thereof and means for securing said wall and being pressed and held therebetween when said cap and wall are secured together, so that said cable cannot be pulled out of said cable receiving chamber.

8. The breathing mask of claim 7 wherein said chamber in said housing includes a post member, said length of cable extending, at least in part, about said post member for absorbing stress on said cable.

9. In a breathing mask adapted to be worn on the face of a human being, said mask including a pliable, air impermeable, generally cup-shaped mask body coupled to a source of a breathing mixture and adapted to be placed on the face of the wearer to form an air seal therewith, an apparatus mounted inside said mask for transmitting the wearer's voice outside said mask, comprising:

a microphone positioned inside said mask and adapted for electrical connection with a point outside said mask, said microphone having a sound sensing diaphragm and being constructed and arranged to generate an electrical signal representing sounds sensed by said diaphragm, a microphone protecting sheath substantially encasing said microphone and including a thin, pliable integral wall in contact with said sensing diaphragm, said sheath wall being set into vibration when the mask wearer sounds his voice, said vibration being communicated to said sensing diaphragm so that an electrical signal representing the wearer's voice is produced by said microphone, and said microphone protecting sheath conforming to and abutting the outer periphery of said microphone except in the region of electrical connection thereto so that no air pockets are formed between said sheath and said microphone, said microphone periphery being substantially rigid except for said sensing diaphragm, and means providing said electrical connection from said body to a point outside said mask, said means protecting said electrical connection from the atmosphere inside said mask and not disturbing the air seal of said mask.

10. The breathing mask of claim 9 wherein said mask body is formed with an aperture therethrough, and further comprising:

a first connector member extending from said microphone and having a mounting surface engaging at least the portion of said mask body surrounding said aperture and on the interior of said mask body, said first connector member including microphone coupling means, connected inside said microphone, for providing an electrical connection to said microphone;

a second connector member including a mounting surface engaging the exterior of said mask body immediately opposite said first connector member and including means mating with said microphone coupling through said aperture;

electrical connection means accessible outside said mask body and connected to said mating means, so that the signal produced by said microphone is available at the electrical connection means of said second connector; and means for joining said first and second connector members with said mask body sandwiched between the mounting surfaces thereof to seal said aperture.

11. The breathing mask of claim 10 wherein one of said first connector member coupling means and second connector member mating means includes at least one electrical plug extending from the mounting surface of the associated one of said first and second connector means, the other of said coupling means and mating means being a receptacle for receiving said at least one plug, one of said plug and receptacle being electrically connected to the interior of the microphone, and said electrical connection means including releasable electrical connection means permitting separation of said second connector member therefrom.

* * * * *